United States Patent [19]

Vogt

[11] 4,088,264

[45] May 9, 1978

[54] MULTIWALL POUCH BAGS FOR DETACHED PACKAGING OF COMMODITIES

[75] Inventor: Russell C. Vogt, Pensacola, Fla.

[73] Assignee: St. Regis Paper Company, New York, N.Y.

[21] Appl. No.: 720,360

[22] Filed: Sep. 3, 1976

[51] Int. Cl.[2] ..... B65D 33/02

[52] U.S. Cl. ..... 229/55; 93/33 H; 93/35 R

[58] Field of Search ..... 229/66, 55, 56; 150/1; 93/33 H, 33 R, DIG. 1, 8 WA, 19, 35 R

[56] References Cited

U.S. PATENT DOCUMENTS

| | | | |
|---|---|---|---|
| 892,074 | 6/1908 | Obici | 229/55 X |
| 1,723,255 | 8/1929 | Rowe | 229/55 |
| 2,898,027 | 8/1959 | Scholle | 229/55 X |
| 3,190,441 | 6/1965 | Rausing | 229/55 X |
| 3,807,626 | 4/1974 | Goodrich | 229/66 |
| 3,868,892 | 3/1975 | Winnemoller | 93/19 X |
| 3,876,486 | 4/1975 | Pennington | 93/DIG. 1 X |
| 3,910,488 | 10/1975 | Goodrich | 229/66 X |
| 3,958,749 | 5/1976 | Goodrich | 229/66 X |
| 3,962,017 | 6/1976 | Wyse | 93/DIG. 1 |

*Primary Examiner*—Stephen P. Garbe
*Attorney, Agent, or Firm*—Raymond J. McElhannon

[57] ABSTRACT

A bag of tubular form open at one end and closed at the other end, consisting essentially in the combination of: an outer tube comprising one or more contiguous plies of non-heat sealable, flexible sheet material, such as paper, and an inner tube comprising a ply of heat sealable, plastic sheet material, all of the plies being bonded together at both ends of the bag, with the inner ply otherwise detached from the outer tube, the outer tube having thermal transmission and flexibility properties such that the inner tube may be heat sealed to closure and severance thereat by compressive heat and creasing pressure applied to the outer tube, the inner tube being heat sealed to closure and terminated by severance adjacent the closed bag end, and the outer tube being closed thereat beyond the closure of the inner tube thereat, the bag being closeable at its open end after commodity charging, by heat sealing to closure and severing the inner tube adjacent the open bag end and then closing the outer tube thereat beyond the closure of the inner tube thereat, whereby upon subsequent opening of the outer plies at a bag end, the commodity charged inner ply may be withdrawn intact therefrom.

8 Claims, 19 Drawing Figures

Fig. 3.
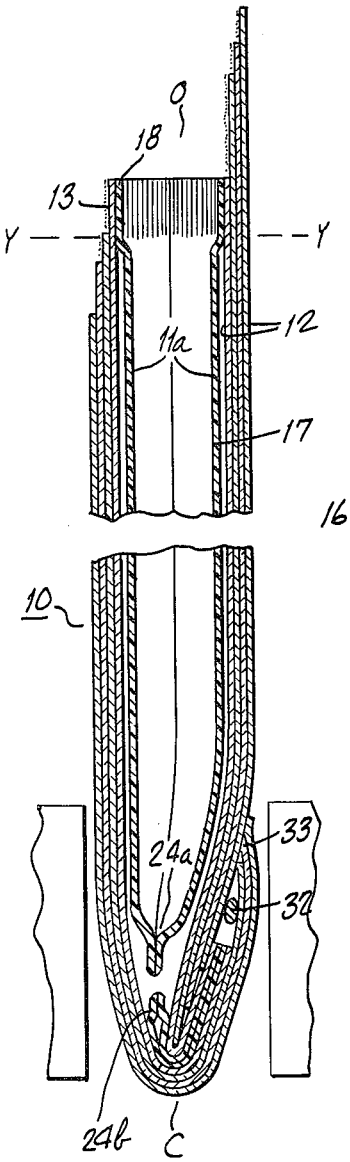
Fig. 7.
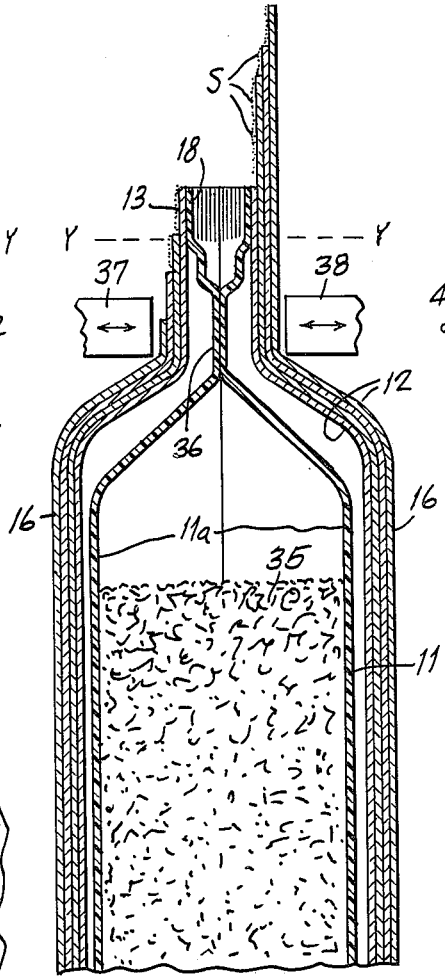
Fig. 8.
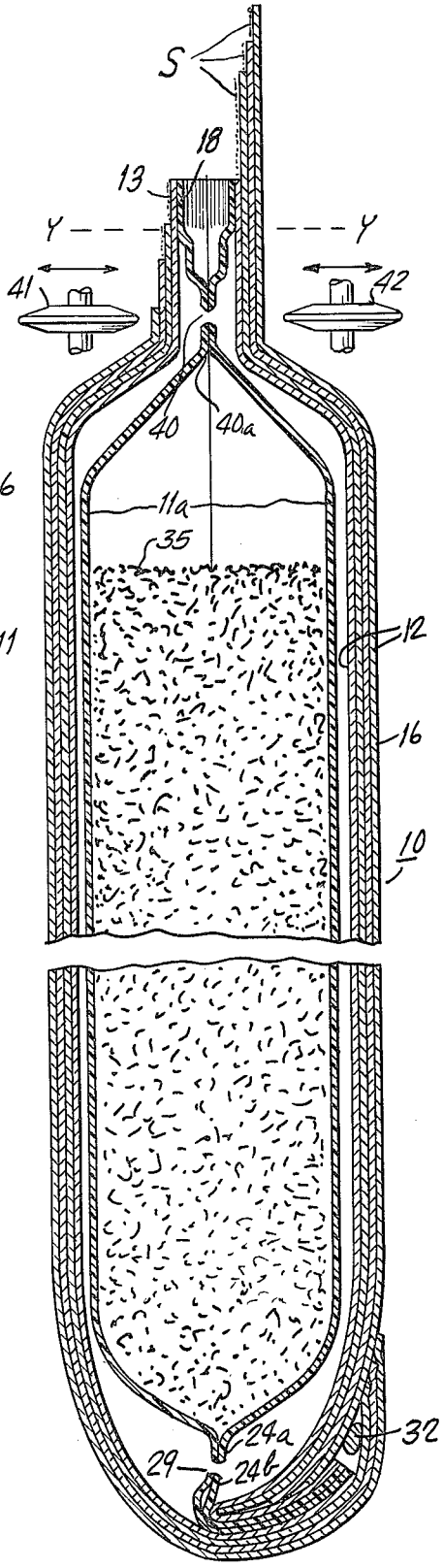
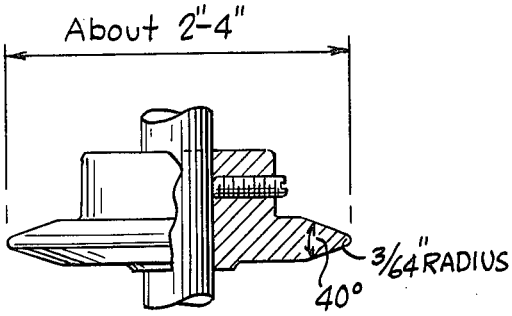
Fig. 6a.

Fig. 11.
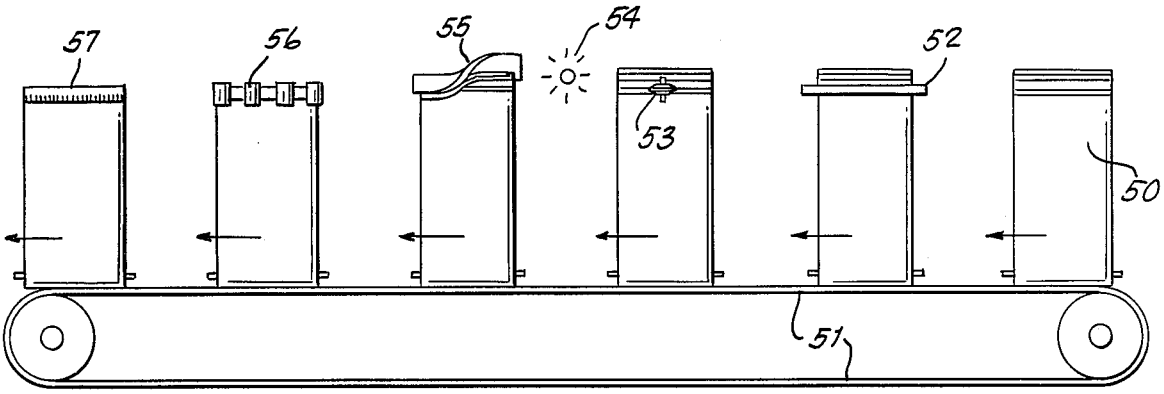
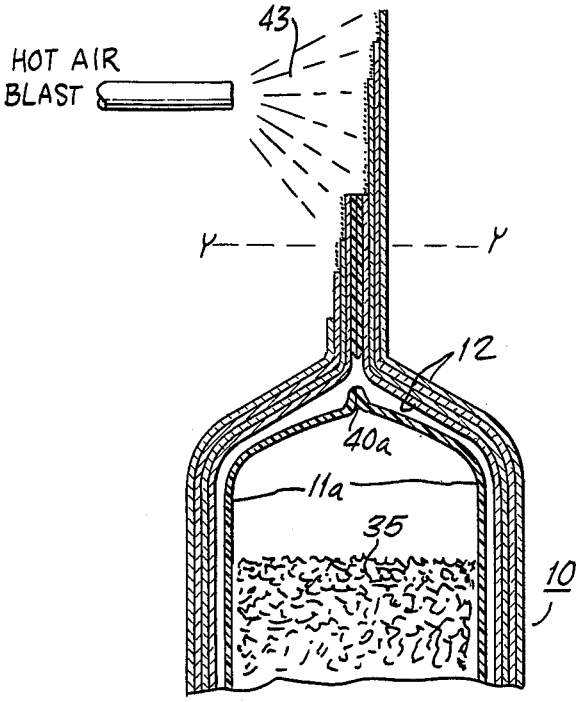
Fig. 9.
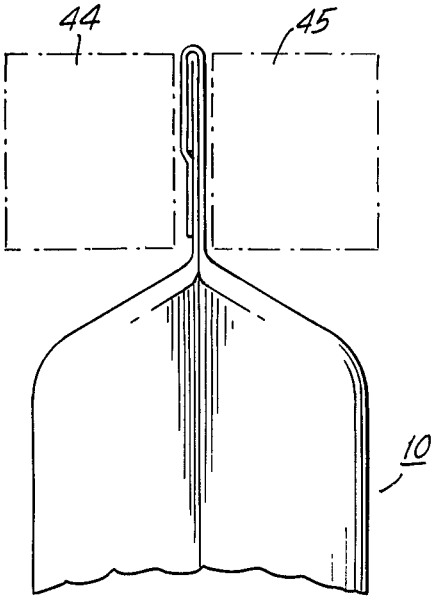
Fig. 10.

Fig. 12.
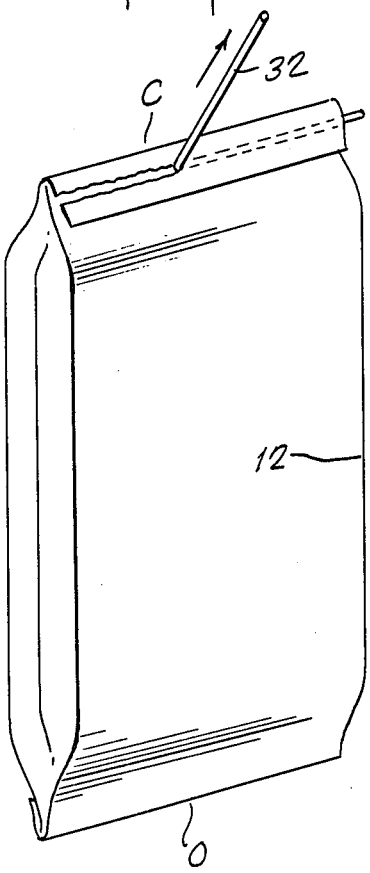
Fig. 13.
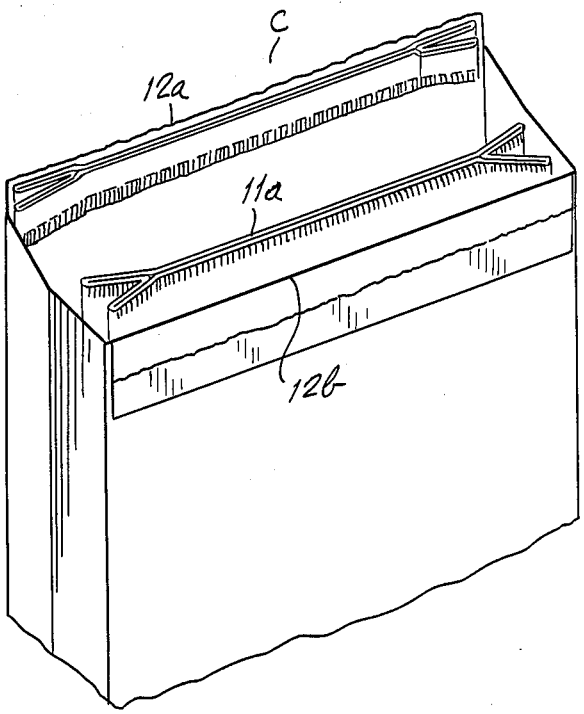
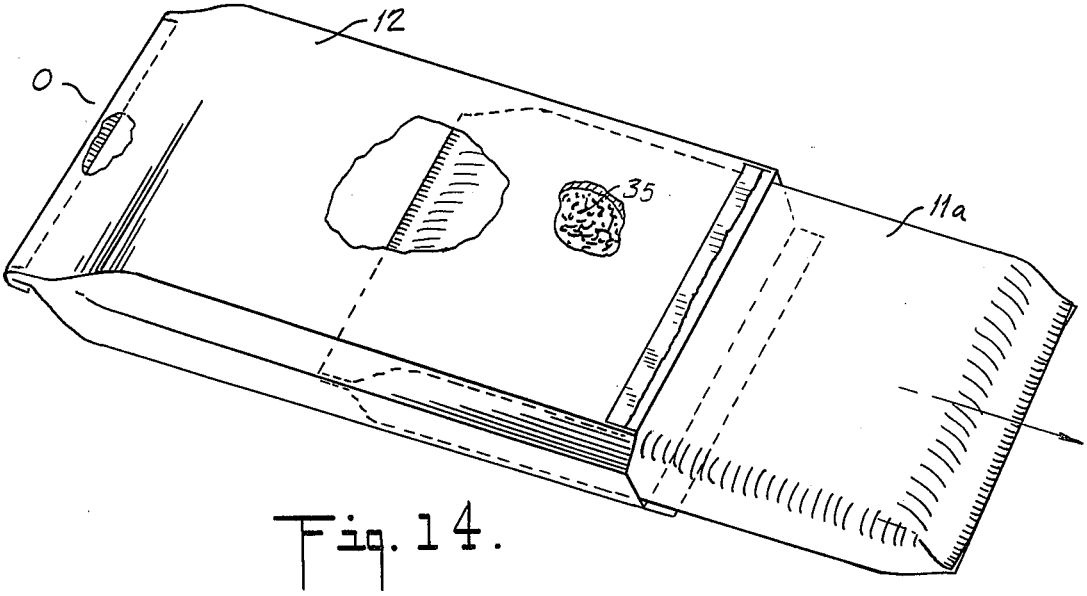
Fig. 14.

FLAT PINCH-BOTTOM POUCH BAG

GUSSETED SEWN POUCH BAG

FLAT SEWN POUCH BAG

MULTIWALL POUCH BAGS FOR DETACHED PACKAGING OF COMMODITIES

This invention pertains to multiwall bags of novel and unique construction, to commodity packaged such bags, and to novel methods and means for producing the same and packaging commodities therein.

The invention pertains more specifically to improvements in multiwall, sewn end or pinch bottom, flat or gusseted, open mouth bags, having an innermost heat sealable, plastic ply integral at the bag ends with one or more outer plies of non-heat sealable material as manufactured, and wherein the plastic ply may be heat sealed to closure and severed from the outer plies at the closed end prior to commodity filling and also after filling, by combined heat and pressure applied to the outermost ply, whereby upon closure of the outer plies at the open bag end, the commodity is packaged within the heat sealed inner plastic ply with the latter sealed within but wholly detached from the outer plies, for removal intact with its packaged contents upon opening the outer plies.

Bags according to the invention thus consist essentially in the combination of: an inner tube or ply of a heat sealable, plastic material, such for example as polyethylene film, and an outer tube comprising one or more plies of a non-heat sealable material, such for example as paper or equivalent flexible sheet material. The inner tube is circumferentially and lightly bonded at its opposite ends to the outer tube but is unattached to the outer tube intermediate said ends. If the outer tube comprises a plurality of plies, these plies are likewise circumferentially bonded to one another at the opposite ends thereof, but are unattached intermediate said ends. The outer tube is constructed to have thermal transmission and flexibility properties such that the inner tube may be transversely heat sealed to closure by compressive heat applied to the outer tube, as by gripping between heated bars, and the inner tube is thence severed in the heat sealed zone while the seal is still hot and plastic, by creasing compression applied to the outer tube, as by passing the outer tube transversely between a pair of bevelled pressure wheels.

A bag blank having inner and outer plies in tegrated in the manner aforesaid and as produced on a conventional tuber is converted into an open mouth bag according to the invention, by first heat sealing and severing the inner tube in its unattached intermediate zone adjacent one end thereof in the manner above stated, to form a pouch of the inner tube which is attached to the outer tube only at the open bag end. The outer plies are then closed at a distance below this sackin a sewn or pinch bottom closure to close the bag at the closed end as manufactured.

The bag as thus formed, constitutes basically the multiwall bag of the present invention, open at one end and closed at the other, ready for use by a packager of a commodity. After the bag is filled at the open end with a commodity to be packaged, the inner pouch into which the commodity is thus charged, is heat sealed to closure adjacent said open end and severed thereat in the manner aforesaid to seal the pouch closed at said end and to completely sever the pouch containing the commodity from the outer tube which is thereupon closed in the outer plies at the open end, again in a sewn or pinch bottom closure.

As thus packaged, the commodity is contained within a completely sealed, sift and leak proof inner pourch which is in turn housed within a completely sealed outer tube for dual protection against contamination, insect penetration, etc., and wherein the inner pouch is completely unattached to the outer tube and may be withdrawn therefrom with its sealed in packaged content, by merely opening the outer tube at one end. For this purpose the outer tube may be provided with an "easy to open" feature such as a rip cord of a sewn end bag or a tear cord of a pinch bottom bag as detailed below.

The invention constitutes an advance in the art over so called "breakaway pouch bags" which have heretofore evolved such as those of U.S. Pat. Nos. 3,807,626; 3,910,488 and 3,958,749 of John J. Goodrich, assigned to St. Regis Paper Company.

In accordance with the inventions of the first two mentioned patents, open end, pinch bottom, multiwall bags are disclosed as having an inner ply of heat sealable plastic material, such as polyethylene, and one or more outer plies of a non-heat sealable material, such as paper or equivalent. The plastic ply is lightly bonded at both bag ends to the contiguous outer ply for manual detachment therefrom. The plastic ply is heat sealed to closure at its base and folded over with the outer plies and the latter adhered to the opposite bag wall in a pinch bottom end closure. At the open bag end after commodity filling, the plastic ply is also heat sealed to closure and folded over with the outer plies, and the latter sealed against the opposite bag wall also in the pinch type end closure. Due to the light bonding action between the plastic ply and the contiguous outer ply, the bag may be opened in the outer plies and the latter stripped from the inner ply, leaving the inner ply intact as heat sealed at both ends and containing the so packaged commodity. This construction is effective for accomplishing its stated objective of providing a breakaway inner pourch bag as aforesaid. However, stipping away the outer plies must be done carefully in order to prevent rupture of the inner pouch. This may be difficult especially in gusseted bags at the corners and also destroys the paper bag.

In the bags of U.S. Pat. No. 3,958,749, employing an inner ply of heat sealable plastic material and one or more outer plies of non-heat sealable material, such as paper of equivalent, the bottom end closure is similar to that above described for the first two patents, whereas at the open bag end the plastic ply is peripherally perforated below the area of bonding of the plastic ply to the contiguous outer ply. The open bag end is closed after commodity filling by sealing the plastic ply below the line of perforations and the outer plies closed above the same. When the filled bag is opened in the outer plies at the bottom closure, by means of a tear cord, the inner ply may be withdrawn intact with its sealed in packaged contents, by tensional severance along said line of perforations. The bag constructions of this patent are likewise effective for accomplishing the stated object of the patent of providing breakaway pouch bags as aforesaid. This construction, however, requires additional perforating equipment on the bag tubing machine for the film and requires precise registration and depth of perforations. Also the bag must be folded accurately in customer closing at the open end after filling, as uneven sealing and folding can cause the bag to seal above the perforations and produce leakage of the packaged production out of the inner pouch.

My invention eliminates destruction of the outer plies to remove the plastic pouch as in the first two of the above patents, and also the additional perforating equipment and problems on the tuber of the patent last discussed. Also with my invention, the sealing and separating of the inner tube being done in line on the customer's closure, eliminates leakage through perforations due to uneven folds. It also provides a free floating pouch in the bag which neither of the aforesaid patented constructions achieve.

In the bags of the present invention wherein the inner plastic ply its completely sealed in packaged contents is completely detached from the outer plies, all that is required for discharging the packaged contents is to open the bag in its outer plies at one end by an easy to open feature as aforesaid, and thence upend the same whereupon the inner ply with its sealed in contents may be gravity dumped from the outer bag structure like dumping a pillow from a pillow case, leaving not only the pouch and its contents intact but also the outer bag structure intact except for the opening at one end, such that the outer bag structure may be reused for other purposes, such as by trimming the end, refilling and closing with a sewn end.

The patents above discussed constitute the prior art most pertinent to the present invention insofar as I am aware. In that connection mention should be made of the practice also known to the art of inserting in an open end multiwall bag, a plastic pouch which is then filled with a commodity to be packaged, such as powdered dry milk, thence closing the pouch with a tie cord, etc., and thence closing the bag at said end, as by sewing or otherwise. However, this procedure involves expensive manual operations of inserting the pouch in each bag and tying closed after filling, etc. The present invention eliminates these defects via automatic production of the bags with the plastic liner and heat sealing and severance of the latter in the bags as manufactured and automatic field end closing of the filled bags in both the inner and outer plies as described below.

Having thus described the invention in general terms, reference will now be had for a more detailed description to the above and other features thereof, to the accompanying drawings wherein:

FIGS. 2 and 3 are, respectively, horizontal and vertical cross sections of the FIG. 1 bag as taken at 2—2 and 3—3 thereof.

Figure 6:
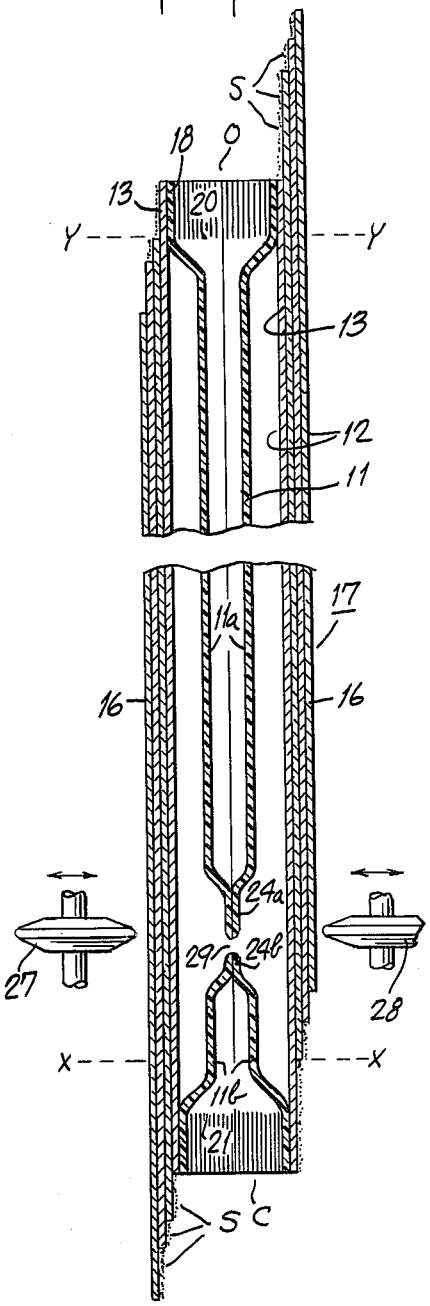
FIG. 6 is a view similar to FIG. 5 illustrating the severance of the inner ply in the heat sealed zone of FIG. 5, by means of bevelled compression rolls creasing the outer bag plies against the inner ply to effect said severance.

FIG. 6*a* is a detail in elevation and partly in section of one of the compression rolls shown in FIG. 6.

Figure 1:
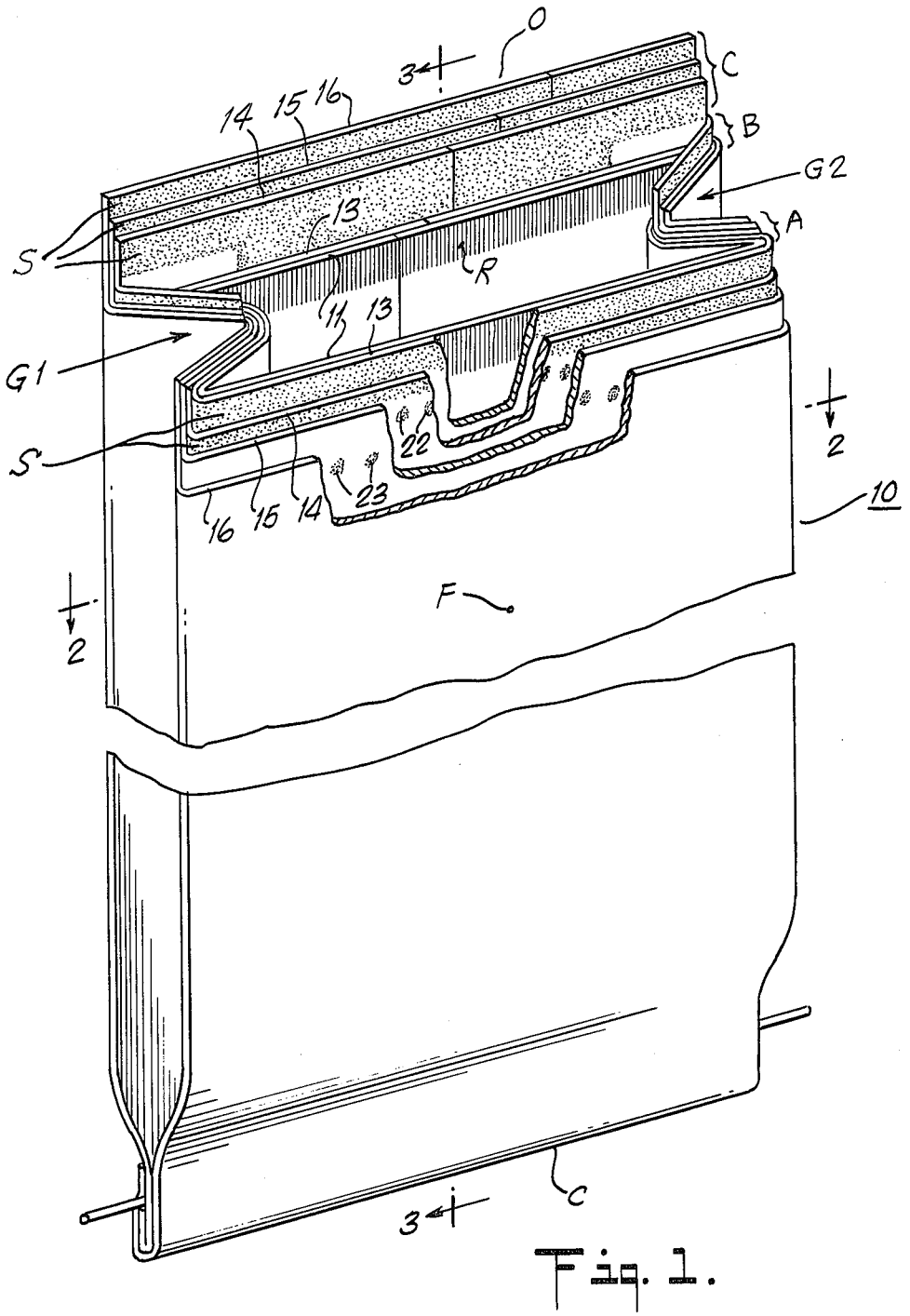
FIG. 1 is a perspective view of a multiwall, gusseted, pinch bottom bag of a preferred construction according to my invention as factory produced and supplied to a packer of the commodity to be packaged.

FIGS. 7–10 inc. are views illustrating the commodity filling and closing of the open ended bag of FIG. 1 wherein: FIG. 7 is an enlarged, fragmentary, longitudinal sectional view of the filled bag as heat sealed at the open bag end.

FIG. 8 is a similar view of the filled bag after severance of the inner ply at the open bag end.

FIGS. 9 and 10 are similar views illustrating respectively, the heat reactivation of a hot melt adhesive applied to the outer plies at the open bag end and the pinch bottom end closure of said plies thereat.

FIG. 11 is a schematic view in elevation of an apparatus for automatically accomplishing in progressive sequence the closing operations illustrated in FIGS. 7–10 inc.

FIG. 12 is a perspective view of the filled bag as top and bottom closed, illustrative of the opening of the outer plies by means of a tear cord at the initially closed bag end, FIG. 13 is a similar view of the so opened bag at said end; while FIG. 14 is a similar view illustrating the withdrawl from the opened bag of FIG. 13, of the inner plastic pouch with its sealed in packaged contents.

Figure 15:
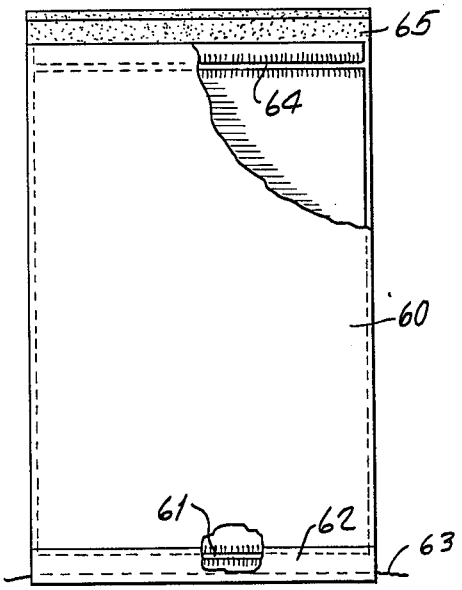
Figure 16:
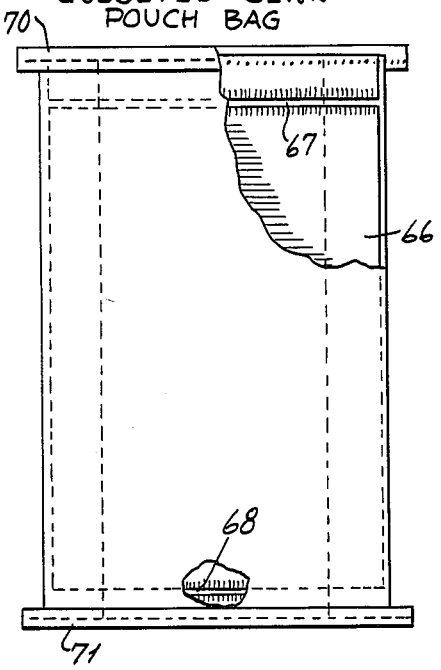
Figure 17:
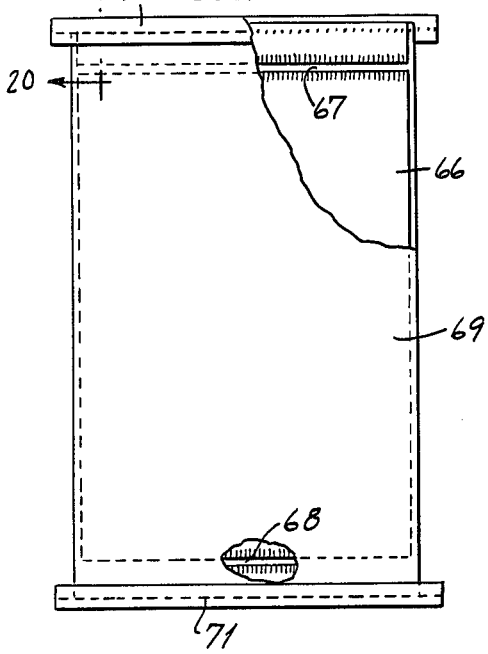

FIGS. 15–18 inc. are views of bags according to further embodiments of the invention wherein:

FIG. 15 is a view in elevation with part broken away of a flat, pinch bottom bag in accordance therewith having stepped plies at the bag ends;

FIG. 16 is a similar view of a gusseted sewn end bag;

FIG. 17 is a similar view of a flat, sewn end gusseted bag; and

Figure 18:
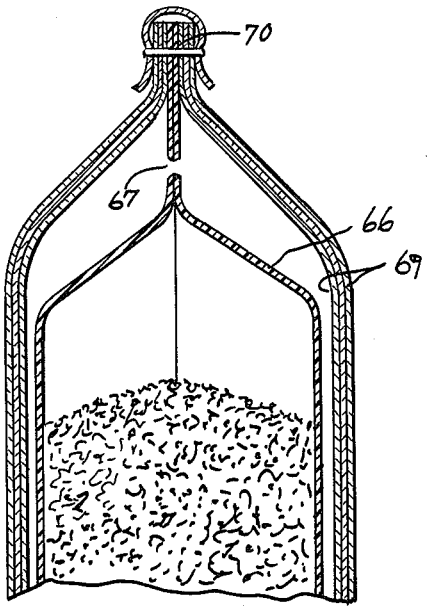

FIG. 18 a partial longitudinal sectional view of each of FIGS. 16 and 17.

Figure 2:
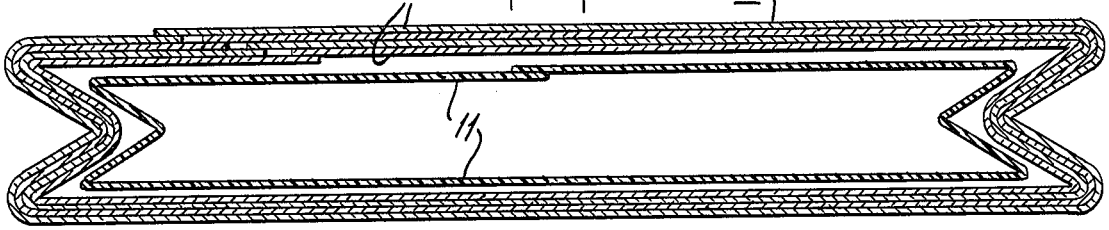

Referring to FIGS. 1–3 inc. the bag 10 therein shown, consists essentially as best shown in the sectional views of FIGS. 2 and 3, of an inner tube 11 of a heat sealable plastic material such as polyethylene, and an outer tube 12, comprising a plurality of contiguous plies 13-16 inc. of a non-heat sealable material, such for example as paper. The bag of FIGS. 1–3 inc. is made from an open ended bag blank as shown at 17, FIG. 4, and as procuded on a conventional stepped and tuber, the inner plastic ply 11 of which is circumferentially bonded at its opposite ends 18 and 19 to the contiguous paper ply 13, leaving the plastic ply detached therefrom throughout its intermediate zone extending between 20, 21. The paper plies 13-16 inc., are in turn circumferentially bonded to each other at both ends of the FIG. 4 blank as by means of the spot pasting shown at 22, 23 of FIG. 1.

Figure 4:
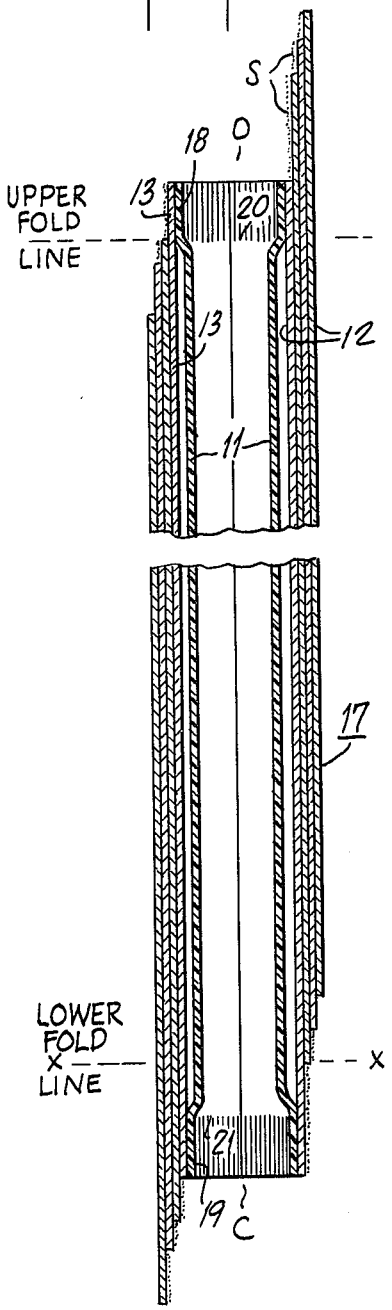
FIG. 4 is a vertical section of an open-ended bag blank as produced on a conventional stepped end tuber, for conversion to a bag according to FIGS. 1–3 inc.

As a first step in converting the FIG. 4 bag blank 17 into the bag of FIGS. 1–3 inc., the inner plastic ply is transversely heat sealed to closure over a zone 24, adjacent the lower end of its unattached intermediate zone 20, 21. This heat sealing is effected by means of a pair of heated bars 25, 26, which are actuated compressively against the oppositely disposed walls of the outermost ply 16 in the manner indicated in FIG. 5. The bars 25, 26 are heated to temperature such as to heat the plastic ply 11 to temperature of plasticity and fusion bonding in zone 24 of the oppositely disposed walls of ply 11. When the plastic ply 11 is made of polyethylene film in accordance with a preferred embodiment of this invention, it is thus compressively heated in zone 24 to temperature of about 190° to 204° C for about 25 seconds at the factory closed bag end C, FIG. 1, and to temperature of about 200° to 250° C for about 8 seconds on field closure of the open bag end O, FIG. 1, as discussed below.

Figure 5:
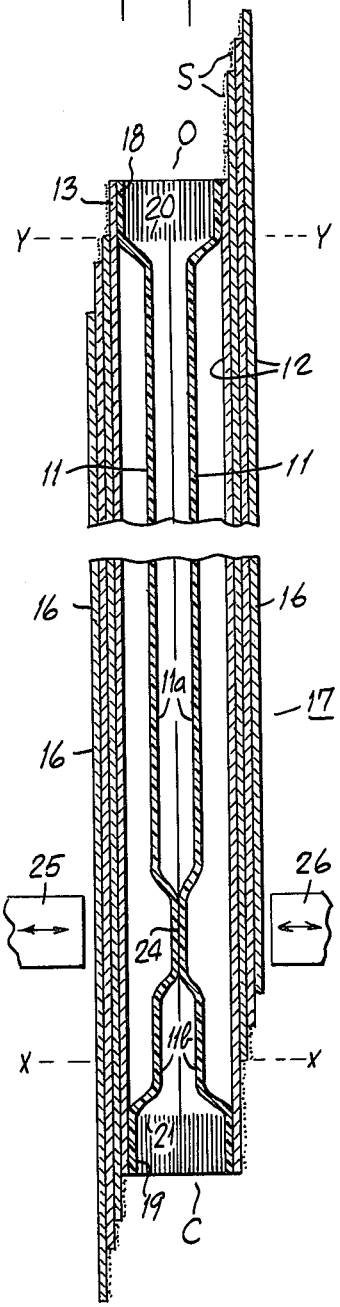
FIG. 5 is a view similar to FIG. 4 illustrative of the heat sealing of the inner ply thereof adjacent to the lower end of the blank by means of hot compression bars applied to the outer ply of the blank.

Immediately following the heat sealing of the inner ply 11 in zone 24, FIG. 5, and while said ply is still heated to plasticity in zone 24, the blank 17 is caused to be laterally traversed by a pair of bevelled compression rolls 27, 28, FIG. 6, suitable dimensions for which are shown in FIG. 6*a*, and which bear against the outermost ply 16 of the blank with compressive force of about 30 lbs./psi, sufficient to crease the outer plies 12 and to completely sever the inner ply 11, as at 29 in the zone 24 into separate upper and lower sections 11*a* and 11*b*. The upper section 11*a* is thus converted into a sack or pouch which is sealed to closure at its lower end 24*a*, and which is unattached to the contiguous paper ply 13, except at the upper portion 18 bonded thereto. This severance is made at a point in the heat sealed zone 24 such that the heat sealed portion 24*a*, is greater than that of 24*b* to impart maximum sealing strength to the bottom closure of the upper or sack portion 11*a* of the inner tube 11.

The bag blank as thus fabricated to the stage FIG. 6, is now ready for closure in its outer plies at its lower end, in a sift and leak proof pinch bottom closure involving a stepped end construction thereof as follows. Reverting to FIG. 1 it will be noted that in accordance with the preferred embodiment of the invention as thus illustrated, the bag in its thus assembled condition, is open at the top O and closed at the bottom C, and has a front wall F and rear wall R, with a pair of oppositely disposed gussets G-1 and G-2 interposed between said walls. At the open bag end O, each gusset has a front gusset portion A, and a rear gusset portion B which is stepped up and exposed above the front gusset portion A thereof, and a rear wall portion C which is stepped up and exposed above the rear gusset portion B. Also the outer bag plies 13-16 inc. are progressively stepped up from the outermost to the innermost ply in the front wall and rear gusset portions and are stepped up in the reverse order from the innermost to the outermost ply in the rear wall, thus to expose portions of said outer plies in the same ascending order from the front wall via the rear portions to the rear wall. The inner plastic ply 11 is flush cut with the contiguous paper ply 13 in the front and rear walls as shown. For closing the bag in its outer plies 13-16 at the open end O, a hot melt reactivatable adhesive in a dormant state is preapplied to at least parts of the exposed portions B and C inc. thereof, and optionally also to some of front wall plies, as indicated by the stippling S. A suitable adhesive is a thermoplastic resin adhesive which may be a composition of polyethylene, wax and a tackifier, such as a rosin ester.

Reverting now to FIG. 6, the bag is factory closed in the outer plies at the closed end C, by application of the aforesaid hot melt adhesive, as at S, to the lower end of FIG. 6, and thence folded over along a transverse fold line *x—x* and about an interposed tear cord 32, FIG. 3, and sealed against the opposite bag wall, as at 33, FIG. 3.

The procedure for closing the open bag end O, FIGS. 1 and 3, after filling with a commodity to be packaged, is similar to that above described with reference to the closed end C. Thus referring to FIG. 7, after the bag has been filled with a commodity 35 to be packaged, the inner ply 11 is heat sealed to closure below its upper bonded end 18, and as at 36, by acutation of hot compression bars 37, 38, against the oppositely disposed walls of the outermost ply 16. The inner ply 11 is thence severed in the heat sealed zone 36, and as at 40, FIG. 8, by means of bevelled compression rolls 41, 42, FIG. 8. The open bag end is thence closed in the outer plies, by reactivation of the hot melt adhesive S preapplied to the open bag end as above discussed, and in the manner illustrated by the hot air blast 43, FIG. 9, and the outer plies folded over about the fold line *y—y*, and sealed against an outer wall of the bag by passage between pressure rolls 44, 45, FIG. 10.

Thus after the filled bag as illustrated in FIG. 8 is closed in this manner at its open end, the packaged contents 35 will be completely sealed within the plastic pouch 11*a*, as now heat sealed to closure at both ends 40*a* and 24*a*, and the latter will be wholly detached from the outer plies 12. Hence when the bag is opened in its outer plies by manuipulation of the cord 32, FIG. 12, and as at 12*a*, 12*b*, FIG. 13, the heat sealed pouch 11*a*, FIGS. 13 and 14, containing the commodity 35, can be discharged intact without additional injury to the outer plies 12, FIG. 14, which being sealed closed at the bag end O, comprise an outer ply bag which may be used for other purposes.

The stepped gusset, stepped ply, pinch bottom end closure construction of the FIG. 1 bag, as closed at both ends an in FIGS. 8 and 12, in its outer plies 12, provides in and of itself a sift and leak proof enclosure for the inner commodity containing heat sealed pouch 11*a*. Hence even if the latter should inadvertently be broken, as in rough handling or dropping from excessive heights, the commodity will still be retained in the sift and proof casing formed by the completely sealed outer bag 12, FIG. 12.

FIG. 11 illustrates schematically, a method and means for field colosing the open end of the FIGS. 1—5 inc. bag, aftern filling. The filled bag 50, successively loaded on an endless conveyor belt 51, and fed thence between a pair of opposite disposded hot compression bars, as at 52, for heat sealing the inner bag ply at the open bag end at about 200°–265° C for about 8 seconds, thence between a pair of bevelled rolls, as at 53, for severing said inner ply thereat while the heat seal is still hot plastic, thence past a hot air blast, as at 54, for reactivating at about 260° C for a few seconds, the hot melt adhesive preapplied to the outer bag plies, thence through a folding device 55, for folding the outer bag plies over onto the outer bag wall, thence between pair of squeeze rolls, as at 56, for adhesively bonding the outer ply closure, and thence to a delivery station as at 57.

Referring now to FIG. 15, the invention may be applied to non-gusseted or flat, stepped end pinch bottom bags, as at 60, the inner plastic ply of which is heat sealed and severed at the factory closed bottom closure as at 61, and the outer plies thence pinch bottom closed, as at 62 with an interposed tear cord, as at 63. After filling, the top closure is effected by heat sealing and severing the inner ply as at 64, and the outer ply closure accomplished by reactivating the preapplied hot melt adhesive 65, and folding over the outer plies and sealing against the outer bag wall.

The invention is also applicable to sewn end bags, both gusseted and non-gusseted or flat as illustrated in FIGS. 16 and 17, respectively, and in FIG. 18 in section. In each of these figures the heat sealed inner ply is shown at 66, as heat sealed and severed adjacent both bag ends, before and after filling, respectively, as at 67, 68, and the outer plies 69, sewn closed at both bag ends with tape overlaps, as at 70, 71.

Multiwall bags according to the invention find special utility for the packaging and shipment in about 25 to 100 pound lots, of powdered comestibles, such as powdered dry milk or eggs, flour, soya meal, cereals, and also chemicals, such as pharmaceuticals, and oderiferous materials, such as fertilizer.

Bags according to the invention may be produced by superimposing one or more plies of non-heat sealable material and a ply of heat sealable material in laterally offset relation, bonding said plies together at opposite ends thereof with said plies unattached intermediate said ends, forming said so bonded plies into a tube by adhering each ply to itself along laterally offset edges, with said heat sealable ply disposed within said non-heat sealable plies, heat sealing opposed walls of the inner ply to closure over a zone adjacent one end of the so formed tube by sufficient compressive heat applied to the outer ply thereof, to fuse said opposed inner ply walls together and thence severing said inner ply in said heat sealed zone while at said fusion heat, by creasing compression applied to the outer ply, thence closing said outer plies at said end beyond said severance of said inner ply, in a sewn end or pinch bottom closure, whereby said inner ply is attached to said outer plies only at the opposite ends of each. The tubing and bonding operations may be carried out on a conventional tuber, such as that of U.S. Pat. No. 2,897,730 to R. M. Browning, and by the method described therein.

Refering to FIG. 1, the stepping pattern at the bag ends, may be modified, referring to the open bag end O, to step the front gusset panels A up with respect to the front wall F, retaining the rear gusset panels B stepped up with respect to the front gusset panels, and the rear wall C stepped up with respect to the rear gusset panels. Also some or all of the plies may be successively stepped up in the front panels in the order progressing from the innermost to the outermost ply and in the rear gusset panels in the order progressing from the outermost to the innermost ply in the front gusset panels. These modifications enhance the resistance to sifting, leakage and insect penetration of the outer bag structure.

What is claimed is:

1. A bag of tubular form consisting essentially in the combination of: a pair of inner and outer tubes of, respectively, heat sealable and non-heat sealable materials in wall thicknesses adapted for heat sealing said inner tube to closure through said outer tube and severing said inner tube thereat by creasing said outer tube, said tubes being bonded together at opposite ends thereof but being otherwise detached, said inner tube being heat sealed to closure over a zone adjacent one end thereof and severed thereat to form an upper portion heat sealed to closure at its base and a detached lower portion bonded to said outer tube, the outer said tube being closed below said zone at said end, the opposite bonded ends of said tube being open but adapted for closure by heat sealing said inner tube to closure over a zone adjacent said end and severing thereat and thence closing the outer said tube above said zone.

2. A multiwall bag of tubular form, open at one end and closed at the other, comprising a plurality of contiguous outer plies of paper and an innermost ply of heat sealable plastic material, said innermost ply being heat sealable to closure and severance thereat by heat and scoring pressure applied to the outermost ply, all of said plies being bonded together at the opposite ends of said tube but being otherwise unattached, said plastic ply being transversely heat sealed to closure over a zone adjacent said closed bag end and being transversely severed in said zone to form an upper portion heat sealed to closure at its base, the paper plies at said closed end being closed below the closed of said end plastic ply, the open bag end being adapted for closing after commodity filling by transversely heat sealing said innermost ply to closure over a zone adjacent said upper end and transversely severing thereat, and thence closing said paper plies above the heat sealed zone thereat.

3. A multiwall bag of tubular form, open at one end and closed at the other, comprising a plurality of contiguous outer plies of paper and an innermost ply of heat sealable plastic material, said innermost ply being heat sealable to closure and severance thereat by heat and scoring pressure applied to the outermost ply, all of said plies being bonded together at the opposite ends of said tube but being otherwise unattached, said plastic ply being transversely heat sealed to closure over a zone adjacent said closed bag end and being transversely severed in said zone to form an upper portion heat sealed to closure at its base, the paper plies at said closed end being closed below the closed end of said plastic ply, the open bag end being adapted for closing after commodity filling by transversely heat sealing said innermost ply to closure over a zone adjacent said upper end and transversely severing in said zone, and thence sealing said paper plies to closure above the heat sealed zone thereat, whereby said commodity is sealed within said plastic ply, and said plastic ply is wholly enclosed within an outer sealed casing comprising said paper plies by wholly detached therefrom.

4. The method of producing a tubular bag consisting essentially of inner and outer tubes of, respectively, heat sealable and non-heat sealable materials, which comprises: superimposing a ply of one said material on a ply of the other in laterally offset relation, bonding said plies together at opposite ends thereof with said plies unattached intermediate said ends, forming said plies into a tube by bonding each ply to itself along laterally offset edges, with said heat sealable ply disposed within said nonheat sealable ply, heat sealing the inner said ply to closure over a zone adjacent one end of the so formed tube by heat applied to the outer tube and thence severing said inner tube in said heat sealed zone while hot by creasing said outer tube, thence closing said outer tube at said end beyond said severance of said inner tube, whereby said inner tube is attached to said outer tube only at the opposite ends of each.

5. A sift and leak proof commodity package, comprising: an inner tube of heat sealable and moisture impervious plastic material and a contiguous outer tube of non-heat sealable material and of thermal transmission properties and flexibility such that said inner tube may be heat sealed to closure and severed by compressive heat and creasing pressure applied to said outer tube, said inner tube being circumferentially bonded to said outer tube at one tube end but being otherwise detached therefrom, and being sealed closed and terminating adjacent the opposite tube end, said outer being closed at said opposite tube end beyond said inner tube closure, said inner tube containing a commodity and being sealed closed above said commodity adjacent said end and separated from said outer tube by severance of said plastic inner tube thereat, and said outer tube being closed beyond said severance of said inner tube at said one tube end, whereby said commodity containing inner tube is sealed closed at both ends, completely detached from and disposed within said completely closed outer tube, and may be withdrawn therefrom intact on subsequent opening of said outer tube.

6. A sift and leak proof commodity package, comprising: an outer tube and an inner tube, said outer tube being composed of a plurality of plies of non-heat sealable, flexible sheet material, and said inner tube being formed of a ply of heat sealable and moisture impervious plastic sheet material, all of said plies being bonded together at both ends of said tubes, with said inner ply otherwise detached from the contiguous outer ply, said outer tube having thermal transmission and flexibility properties such that said inner tube may be heat sealed to closure and severance by compressive heat and creasing pressure applied to said outer tube, said inner tube being heat sealed to closure and separated from said outer tube by severance of said inner plastic tube adjacent one end of said tubes, and said outer tube being closed beyond said severance of said inner tube at said end, said inner tube containing a commodity, said inner tube being heat sealed to closure adjacent its opposite end beyond said commodity and being separated from said outer tube by severance of said inner plastic tube thereat, and said outer tube being closed at said end beyond said severance of said inner tube thereat, whereby said commodity containing inner tube is sealed closed at both ends completely from and disposed within said completely closed outer tube, and may be withdrawn therefrom intact on subsequent opening of said outer tube.

7. The method of producing a tubular bag consisting essentially of inner and outer tubes of, respectively, heat sealable and non-heat sealable materials, which comprises: superimposing a ply of one said material on a ply of the other in laterally offset relation, bonding said plies together at opposite ends thereof with said plies unattached intermediate said ends, forming said so bonded plies into a tube by adhering each ply to itself along laterally offset edges, with said heat sealable ply disposed within said non-heat sealable ply, heat sealing opposed walls of the inner said ply to closure over a zone adjacent one end of the so formed tube by sufficient heat applied to the outer to fuse said opposed walls together and thence severing said inner tube in said heat sealed zone while at said fusion heat by creasing said outer tube, thence closing said outer tube at said end beyond said severance of said inner tube, whereby said inner tube is attached to said outer tube only at the opposite ends of each.

8. The method of producing a tubular bag consisting essentially of inner and outer tubes of, respectively, heat sealable and non-heat sealable materials, which comprises: superimposing a plurality of plies of said non-heat sealable material and a ply of said heat sealable material, in laterally offset relation, bonding said plies together at opposite ends thereof with said plies unattached intermediate said ends, forming said so bonded plies into a tube by adhering each ply to itself along laterally offset edges, with said heat sealable ply disposed within the innermost of said non-heat sealable plies, heat sealing opposed walls of the inner said ply to closure over a zone adjacent one one end of the so formed tube by sufficient heat applied to the outer tube to fuse said opposed walls together and thence severing said inner tube in said heat sealed zone while at said fusion heat by creasing said outer tube, thence closing said tube at said end beyond said severance of said inner tube, whereby said inner tube is attached to said outer tube only at the opposite ends of each.

* * * * *